United States Patent [19]

Elliott

[11] Patent Number: 4,721,965

[45] Date of Patent: Jan. 26, 1988

[54] AM-FM-CELLULAR TELEPHONE MULTIBAND ANTENNA FOR MOTOR VEHICLE

[75] Inventor: James O. Elliott, Beavercreek, Ohio

[73] Assignee: General Motors Corporation, Detroit, Mich.

[21] Appl. No.: 821,437

[22] Filed: Jan. 22, 1986

[51] Int. Cl.[4] ..... H01Q 1/10

[52] U.S. Cl. ..... 343/715; 343/903

[58] Field of Search ..... 343/749, 750, 828, 889, 343/903

[56] References Cited

U.S. PATENT DOCUMENTS

| | | | |
|---|---|---|---|
| 1,783,025 | 11/1930 | Meissner | 343/749 |
| 2,648,771 | 8/1953 | Cork | 343/749 X |
| 2,854,667 | 9/1958 | Taylor et al. | 343/750 |
| 2,898,590 | 8/1959 | Pichitino | 343/722 |
| 3,172,109 | 3/1965 | Senrui | 343/749 |
| 3,419,869 | 12/1968 | Altmayer | 343/749 X |
| 3,445,849 | 5/1969 | Sanford | 343/702 |
| 4,041,498 | 8/1977 | Freimark et al. | 343/749 |
| 4,095,229 | 6/1978 | Elliott | 343/889 X |
| 4,117,493 | 9/1978 | Altmayer et al. | 343/750 |
| 4,675,687 | 6/1987 | Elliott | 343/715 |

*Primary Examiner*—Daniel M. Yasich

*Attorney, Agent, or Firm*—Robert M. Sigler

[57] ABSTRACT

An AM-FM-cellular telephone multiband antenna adapted for mounting on a motor vehicle fender includes a first mast section having a length of one quarter wavelength at a first frequency near 835 MHz in the cellular telephone band, a phasing coil connected collinearly above the first mast section and having an effective electrical length of three halves wavelength at the first frequency and a second mast section connected collinearly above the phasing coil and having a length of one half the wavelength at the first frequency, whereby the phasing coil and second mast section increase the gain of the total assembly compared to a quarter wavelength antenna for cellular telephone operation at frequencies near the first frequency and further tune the antenna to resonance at a second frequency in the FM radio while providing reception at frequencies in the AM radio band. The antenna is especially suited for power telescoping operation.

2 Claims, 2 Drawing Figures

AM-FM-CELLULAR TELEPHONE MULTIBAND ANTENNA FOR MOTOR VEHICLE

BACKGROUND OF THE INVENTION

This invention relates to an antenna for a motor vehicle which is capable of full duplex operation in the cellular telephone frequency band of 825–890 MHz and is also effective to receive normal commercial AM and FM broadcasts. It is especially directed toward such an antenna adaptable for power telescoping operation from a fender of the vehicle.

Commercially available antennas for vehicle mounted cellular telephones are generally separate antennas adapted for operation from the roof of the vehicle. However, it is physically difficult to mount and connect an antenna on a vehicle roof. Also, with a separate AM-FM antenna, the resulting multiplicity of antennas is considered by many to be unattractive in appearance. Finally, many motorists prefer a power antenna which retracts when not in use and is thus less subject to accidental damage and vandalism. Such an antenna cannot be mounted in the roof; but is more suited for mounting in the vehicle fender, where there is room for the retracted antenna parts.

SUMMARY OF THE INVENTION

An antenna which is adapted for power telescoping operation and allows AM, FM and full duplex cellular telephone operation by a single multiband unit from a vehicle fender comprises a first mast section having a length of one quarter wavelength at a first frequency near 835 MHz in the cellular telephone band, a phasing coil connected collinearly above the first mast section and having an effective electrical length of three halves wavelength at the first frequency and a second mast section connected collinearly above the phasing coil and having a length of one half wavelength at the first frequency. The phasing coil and second mast section add gain to the first mast section at frequencies in the cellular telephone band and tune the antenna to resonance at a second frequency in the FM radio band while also providing reception at frequencies in the AM radio band.

The antenna is particularly well suited for adaptation as a power telescoping antenna wherein an electrically conductive shield tube extends downward into the motor vehicle from the exterior surface of the fender, an electrically conductive fixed tube is disposed within the shield tube and electrically insulated therefrom, a mast tube is adapted to contact the fixed tube and telescope in and out of the shield tube, the mast tube includes an electrically conducting lower portion comprising the aforementioned first mast section and an electrically insulating upper portion, the aforementioned phasing coil is disposed in the upper portion of the mast tube above the first mast section and connected collinearly therewith, a contact element is disposed in the upper portion of the mast tube above the phasing coil and connected collinearly therewith, a mast rod is adapted to contact the contact element and telescope in and out of the mast tube and fixed tube, the mast rod and contact element together comprise the aforementioned second mast element, a coaxial antenna feed is connected to the fixed and shield tubes for coaxial communication through the fixed and shield tubes to the lower end of the first mast element, the feed is located in the side of the fixed and shield tubes at a distance below the lower end of the first mast element such that the transmission line reactance of the fixed and shield tubes from the feed to the first mast element cancels the stub reactance of the fixed and shield tubes below the feed, as reflected back to the feed, and power means are selectively activatable to telescope the antenna in and out of the fixed tube.

Thus the power telescoping version of the antenna also allows AM, FM and full duplex cellular telephone operation by a single multiband unit when extended and is protected when telescoped into the shield tube. Further details and advantages will be apparent from the accompanying drawings and following description of a preferred embodiment.

DESCRIPTION OF THE PREFERRED EMBODIMENT

Figure 1:
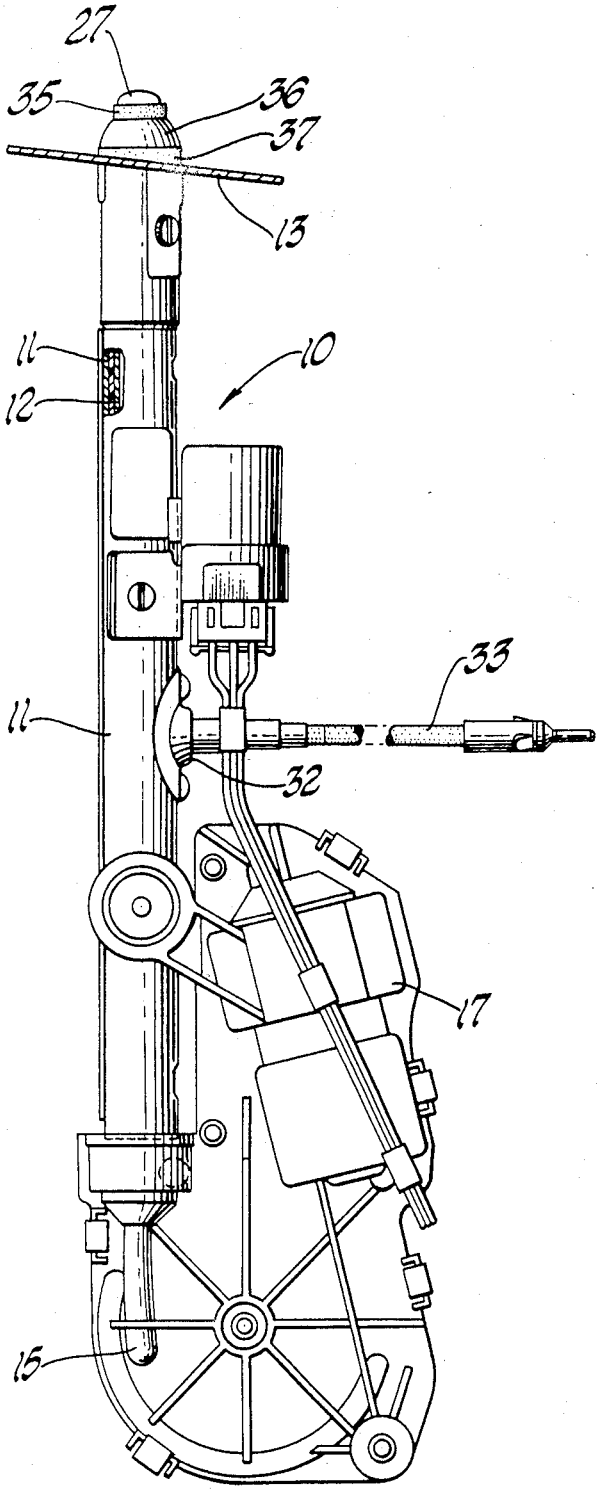
FIG. 1 is an elevational view of a power telescoping embodiment of the antenna of this invention in its fully retracted state.

Referring to FIG. 1, a power antenna assembly 10 includes a shield tube 11 having attachment means, to be described below, adapted to physically connect the top thereof to a surface of a vehicle fender 13. The word fender as used in this description and the following claims is intended to be broadly interpreted to mean any of the front or rear fenders or similar surfaces of the vehicle. A fixed mast version of the antenna could, of course, be mounted on the vehicle roof or trunk lid, if desired; but such mounting would be impractical for the power telescoping version for the obvious reason that the shield tube and drive apparatus must be placed below the vehicle mounting surface. The bottom of the shield tube is open to a cable guide 15 containing a drive cable, not shown. The cable guide 15 and cable extend to a reversible DC electric motor and winding drum unit 17. The cable, drum and motor portion of assembly 10 is conventional and described in detail in the literature, so further description of these elements will not be given here.

Figure 2:
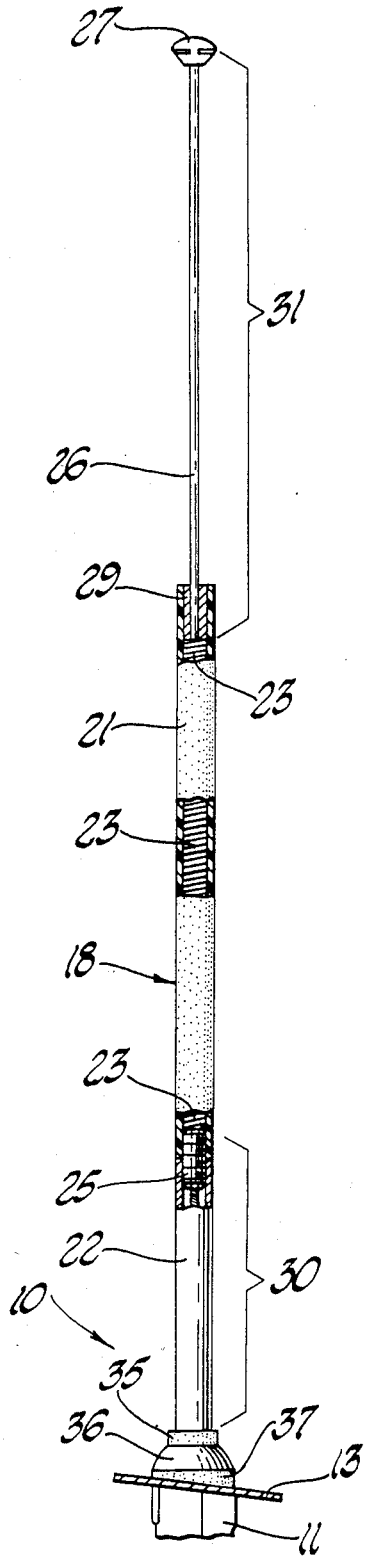
FIG. 2 is an elevational view of the fully extended portion of the antenna of FIG. 1 which projects out of the shield tube.

Situated coaxially within shield tube 11 of FIG. 1 is a fixed tube 12, also electrically conducting and insulated from shield tube 11. Telescoped therein are a plurality of mast members, which will be identified with reference to FIG. 2, wherein they are shown fully extended. A mast tube 18 is smaller in diameter than fixed tube 12, physically and electrically in contact with fixed tube 12 and adapted to slide therein between retracted and extended positions as in FIGS. 1 and 2, respectively.

Mast tube 18 includes an upper portion 21 and a lower portion 22. Lower portion 22 comprises an electrically conducting metal tube 3.00 inches (7.62 cm) long, the upper 0.375 inch (0.95 cm) being internally threaded. The electrically conducting metal portions of the antenna may be made of chrome plated brass, stainless steel or any other suitable metal. Upper portion 21 comprises a tube made of an insulating thermoplastic resin such as Celcon (R) or any similar material which is easily worked or molded, has good dielectric properties and can be colored to blend with the metal lower portion 22. Upper portion 21 contains a phasing coil 23, made of wire coiled around the internal surface of tube 21 and having an equivalent electrical length of three halves wavelength at 835 MHz. The particular coil used happens to be, physically, approximately 6.125 inches (15.56 cm) long; however, this physical length is determined partly by the characteristics of the coil wire, diameter, and other factors. The equivalent electrical length of the phasing coil 23 at 835 MHz is designed to be 19.5 inches (49.5 cm), which is effectively three halves an electromagnetic wavelength in an antenna at that frequency. The phasing coil is soldered at its lower end to a short, electrically conducting metal tube 25, the lower portion of which projects out of tube 21 and is externally threaded into the threaded portion of tube 22. The portion of tube 25 within upper portion 21 of tube 18 measures about 0.25 inches (0.63 cm) to create, with tube 22, a first mast section 30 having a total electrical length of 3.25 inches (8.3 cm), one quarter wavelength at 835 MHz. The top of phasing coil 23 is soldered to a one inch (2.54 cm) long electrically conducting metal tube 29 within the top of tube 21.

A mast rod 26 is made of 0.10 inch (0.25 cm) diameter electrically conducting metal and is adapted to telescope within coil 23 and mast tube 21 when retracted but is collinearly connected by sliding physical contact with tube 29 to the top of coil 23 and physically projects out of mast tube 21 when fully extended. The lower end of rod 26 is physically connected to the drive cable for extension and retraction of the antenna movable elements within shield tube 11. The top of rod 26 includes a finial or corona button 27 which also acts as a water seal when the antenna is retracted. The extended rod 26 and tube 29 of mast tube 18 comprise a second mast section 31 above coil 23 having an electrical length of 6.5 inches (16.5 cm), which is one half wavelength at 835 MHz.

The three elements of the antenna work together in three different ways during operation in the three frequency bands assigned to cellular telephone, commercial FM and commercial AM. In the cellular telephone band, full duplex operation is obtained with vehicle transmission in a lower band of 825–845 MHz and fixed station transmission in an upper band of 870–890 MHz. At the center of the vehicle transmission band, 835 MHz, the antenna is a gain antenna with a lower quarter wavelength element comprising first mast section 30 connected collinearly through phasing coil 23 to an upper half wavelength radiating element, second mast section 31. The three halves wavelength electrical length of phasing coil 23 assures currents in phase in first and second mast sections 30, 31 to provide a 3 db gain over an antenna with a quarter wavelength element alone. The antenna is optimized for the center of the vehicle transmission band because this is the most critical band for transmission, due to the physical limitations (power, size) of the vehicle mounted system.

The use of phasing coils at one half wavelength electrical length to produce gain antennas is a well known technique. However, this antenna uses a phasing coil of three halves wavelength rather than one half wavelength, so that the antenna may also be seen as a resonant monopole radiator with the equivalent electrical length of the phasing coil joining the lengths of the first and second mast sections for a combined electrical length of 29.25 inches (74.3 cm), which is well within the commercial FM frequency band. Since the antenna is actually physically shorter than its equivalent electrical length, its resistive impedance will not be optimized at 50 ohms, but the tuning to resonance will cancel the reactance at the tuned frequency to provide good FM performance at a slightly reduced efficiency. Thus, good cellular telephone performance and FM performance are both obtained from a power telescoping antenna.

The antenna further provides reception in the commercial AM band. The total effective electrical length of the antenna at commercial AM frequencies corresponds to its physical length, which is approximately 16 inches (40.6 cm). This is short for an AM antenna but serviceable in strong signal areas.

The signal is conducted away from the bottom of the antenna by a coaxial transmission line to a splitter, not shown, which isolates the AM-FM entertainment radio receiver from the cellular telephone apparatus. The splitter allows the cellular telephone to be used simultaneously with the entertainment radio without signal confusion.

In the case of a fixed antenna, tne transmission line may be a cable fitted to a connector at the bottom of the first mast member in the normal manner. However, in the case of the power telescoping antenna, this is not possible, since the shield tube and drive apparatus are in the way. Therefore, shield tube 11 is grounded and fixed tube 12 is used with shield tube 11 as a transmission line connector, with a coaxial feed connector 32 providing a connecting point for the center conductor of a coaxial cable 33 through the side of shield tube 11 to fixed tube 12 and a connection of the outer conductor of coaxial cable 33 to shield tube 11. However, connector 32 must be carefully placed along shield tube 11, since a wavelength at 835 MHz is only 13 inches or 33 cm, which is the same order of magnitude as the shield tube itself. The process is complicated by the fact that the portion of the fixed and shield tubes below the feed point acts as an open stub which reflects a reactance back to the feed point. It is necessary to find a feed point wherein a reactive load of one type, such as inductive, from the stub, is canceled by a reactive load of the opposite type, such as capacitive, in parallel from the transmission line connection to the antenna. In addition, when the reactive effects cancel, the purely resistive impedance remaining should be optimized, if possible, at fifty ohms. Since the total length of the shield tube 11 and the fixed tube within it is fixed, the stub and transmission line change length in equal and opposite directions as the feed point is varied. For any given apparatus of shield tube, fixed tube and dielectric insulator there is a feed point wherein the reactances cancel. However, the resistance may not be optimum. Thus some property of the shield tube, fixed tube or dielectric is varied to improve the resistance while the feed point is simultaneously varied to maintain cancellation of the reactances. Those skilled in the art will know how to calculate the optimum feed point according to the principle described above. In the embodiment shown, the feed point turns out to be slightly more than one half wavelength at 835 MHz down from the top of the shield tube.

At the junction of the shield tube 11 and fender 13, an insulating tube 35, having an externally threaded portion, projects upward from shield tube 11 through an opening in fender 13. This tube has internal sealing means to prevent water from entering shield tube 11 with the antenna extended. It also provides the means for a nut 36 to screw down against an insulating wedge 37 to hold shield tube 11 tight against the underside of fender 13 for grounding. Tube 35 and wedge 37 are made from an insulating material in order to electrically separate tube 22 of the antenna from the ground potential of fender 13 and shield tube 11 while minimizing the antenna's capacitance to ground, which could otherwise be highly deleterious to the antenna's performance at 835 MHz.

The embodiments of the invention in which an exclusive property or privilege is claimed are defined as follows:

1. An AM-FM-cellular telephone multiband antenna adapted for mounting in a protective fashion on a motor vehicle fender, the antenna comprising, in combination:

a first mast section having a length of one quarter wavelength at a first frequency near 835 MHz in the cellular telephone band;

a phasing coil connected collinearly above the first mast section and having an effective electrical length of three halves wavelength at the first frequency; and a second mast section connected collinearly above the phasing coil and having a length of one half wavelength at the first frequency, whereby the phasing coil and second mast section substantially increases the gain of the total assembly compared to a quarter wavelength antenna for cellular telephone operation at frequencies near the first frequency and further tune the antenna to resonance at a second frequency in the FM radio band while providing substantial reception at frequencies in the AM radio band when the antenna is in an extended position.

2. A power telescoping AM-FM-cellular telephone multiband antenna adapted for mounting on a motor vehicle fender, the antenna comprising, in combination:

an electrically conductive shield tube extending downward into the motor vehicle from the exterior surface of the fender;

an electrically conductive fixed tube within the shield tube and electrically insulated therefrom;

a mast tube adapted to contact the fixed tube and telescope in and out of the fixed tube, the mast tube including an electrically conducting lower portion comprising a first mast section having a total length when fully extended out of the shield tube of one quarter wavelength at a first frequency near 835 MHz in the cellular telephone frequency band and an electrically insulating upper portion;

a phasing coil in the upper portion of the mast tube above the first mast section and connected collinearly therewith, the phasing coil having an effective electrical length of three halves wavelength at the first frequency;

a contact element in the upper portion of the mast tube above the phasing coil and connected collinearly therewith;

a mast rod adapted to contact the contact element and telescope in and out of the mast tube and fixed tube, the mast rod and contact element together comprising a second mast section connected collinearly above the phasing coil and having a length, when the mast rod is extended, of one half wavelength at the first frequency, whereby the phasing coil and second mast section increase the gain of the total assembly compared to a quarter wavelength antenna for cellular telephone operation at frequencies near the first frequency and tune the antenna to resonance at a second frequency in the FM radio band while also providing reception at frequencies in the AM radio band;

a coaxial antenna feed connected to the fixed and shield tubes for coaxial communication through the fixed and shield tubes to the lower end of the first mast element, the feed being located in the side of the fixed and shield tubes at a distance below the lower end of the first mast element such that the transmission line reactance of the fixed and shield tubes from the feed to the first mast element cancels the stub reactance of the fixed and shield tubes below the feed, as reflected back to the feed; and power means selectively activatable to telescope the antenna in and out of the fixed tube.

* * * * *